US007458219B2

(12) United States Patent
Herzog et al.

(10) Patent No.: US 7,458,219 B2
(45) Date of Patent: Dec. 2, 2008

(54) STEAM POWER PLANT PROVIDED WITH A RETROFIT KIT AND METHOD FOR RETROFITTING A STEAM POWER PLANT

(75) Inventors: Maurus Herzog, Dorf (CH); Richard Brendon Scarlin, Oberflachs (CH); Charles Smadja, Mulhouse (FR)

(73) Assignee: ALSTOM Technology Ltd., Baden (CH)

( * ) Notice: Subject to any disclaimer, the term of this patent is extended or adjusted under 35 U.S.C. 154(b) by 945 days.

(21) Appl. No.: 10/474,367

(22) PCT Filed: Apr. 9, 2002

(86) PCT No.: PCT/IB02/01110

§ 371 (c)(1),
(2), (4) Date: Apr. 27, 2004

(87) PCT Pub. No.: WO02/084080

PCT Pub. Date: Oct. 24, 2002

(65) Prior Publication Data

US 2004/0194467 A1 Oct. 7, 2004

(51) Int. Cl.
*F01K 7/34* (2006.01)

(52) U.S. Cl. ..... 60/653; 60/670

(58) Field of Classification Search ..... 60/653, 60/670–681

See application file for complete search history.

(56) References Cited

U.S. PATENT DOCUMENTS 4,069,674 A * 1/1978 Warren ..... 60/641.8

(Continued)

FOREIGN PATENT DOCUMENTS

DE 195 42 917 A1 6/1996

(Continued)

OTHER PUBLICATIONS

Patti, "Technical Considerations in repowering a nuclear power plant for fossil fueled operation", Energy XP002027853, 96(8): 58648 (Mar. 10-13, 1996).

(Continued)

*Primary Examiner*—Hoang M Nguyen
(74) *Attorney, Agent, or Firm*—Adam J. Cermak; Cermak Kenealy & Vaidya LLP

(57) ABSTRACT

A steam power plant with retrofit kit has a steam generator (1) with superheater, a steam turbine set including condensation installations (11), connecting pipelines, auxiliary devices and a generator (10). The steam power plant (22) is distinguished by the fact that the retrofit kit includes a retrofit turbine module (25) which is designed for elevated temperature and for unchanged or modified pressure and is connected upstream of the existing steam turbine set or is exchanged for the high-pressure turbine of the latter. Furthermore, a method for retrofitting an existing steam power plant includes the following steps: connecting a retrofit turbine module (25) for high operating temperatures and unchanged or modified operating pressure upstream of the existing turbine set or exchanging the existing high-pressure turbine for the retrofit turbine module (25); providing a steam generator (1) and/or superheater (32) for high live steam temperature. This improves the efficiency and/or the service life of an existing steam power plant. The retention of as many original parts of the steam power plant as possible leads to an inexpensive solution for increasing output. Moreover, the general infrastructure can be maintained to the extent that to do so is economical and environmentally compatible.

(Continued)

13 Claims, 7 Drawing Sheets

U.S. PATENT DOCUMENTS

| | | | | | |
|---|---|---|---|---|---|
| 4,996,846 | A | * | 3/1991 | Bronicki | 60/641.2 |
| 5,850,739 | A | * | 12/1998 | Masnoi | 60/653 |
| 6,021,569 | A | * | 2/2000 | Bannister et al. | 29/888 |
| 6,125,634 | A | * | 10/2000 | Wittchow | 60/678 |

FOREIGN PATENT DOCUMENTS

| | | | |
|---|---|---|---|
| DE | 199 23 210 | A1 | 11/2000 |
| DE | 199 62 386 | A1 | 6/2001 |
| DE | 199 62 403 | A1 | 6/2001 |
| WO | WO 96/23961 | | 8/1996 |
| WO | WO 97/18386 | | 5/1997 |
| WO | WO 98/49428 | | 11/1998 |

OTHER PUBLICATIONS

"Repowering Analysis: Hanford Generating Project (HGP), Task order No. 6", Energy XP 002027852, 89(7): 39244 (undated).

Jonas et al., "Der Umbau des Kraftwerkes VEO Eisenhüttenstadt zu einem Kombi-Kraftwerk für die industrielle und öffentliche Energieversorgung", VGB Kraftwerkstechnik 78:8, pp. 34-39 (VGB Kraftwerkstechnik GMBH, Essen, Germany, Aug. 1998).

* cited by examiner

STEAM POWER PLANT PROVIDED WITH A RETROFIT KIT AND METHOD FOR RETROFITTING A STEAM POWER PLANT

BACKGROUND OF THE INVENTION

1. Field of the Invention

The invention relates to a steam power plant with retrofit kit and to a method for retrofitting a steam power plant.

2. Discussion of Background

Power plants with a conventional water/steam cycle are known from the prior art. Known steam turbine installations are formed by a steam turbine set including condensation installation, connecting pipelines and auxiliary devices. The steam turbine set generally comprises multistage steam turbines. The steam turbine set drives a working machine, which in the case of a power plant is formed by a generator. Large steam turbine installations operated with fossil fuels usually employ a process which includes reheating.

A steam power plant with reheating of this nature is diagrammatically depicted in FIG. 7. In this case, condensate or boiler feedwater is heated to the desired steam temperature in a steam boiler 1 including superheater 2. The live steam temperature is generally approximately 520° C. to 565° C., and the live steam pressure is approximately 120 bar to 200 bar. Via live steam valves 3, the steam passes into a high-pressure turbine 4, where the pressure gradient is converted into mechanical energy before the steam, at the outlet, is divided into a stream which is fed to a high-pressure feedwater preheater 21 and a stream which is fed to a reheater 5. The steam which is fed to the high-pressure feedwater preheater 21 is also referred to as bleeder steam for feedwater preheating and is used to heat the feedwater by means of heat exchangers. As has already been mentioned, the second partstream passes via a reheater 5 and collecting valves 6 into an intermediate-pressure turbine 7, where the pressure and temperature are typically 30 to 40 bar and 520° C. to 565° C. Bleeder steam for the feedwater preheating likewise passes from the intermediate-pressure turbine 7 into high-pressure feedwater preheaters 19 and 20 or directly into a feedwater tank 17 connected to a boiler feed pump 18. The other part of the flow of steam, which is also referred to as working steam, passes into a low-pressure turbine 8, from where the working steam which emerges flows into a condensation installation 11 designed as a condenser, in which the steam is condensed by means of a heat exchanger through which cooling water flows. The condensate is preheated by means of, for example, two low-pressure feedwater preheaters, indicated in this figure by reference numerals 15, 16, and is fed to the feedwater tank 17 with the aid of a condensate pump 13. The preheating in the low-pressure feedwater preheaters 15, 16 is carried out using bleeder steam from the low-pressure turbine 8. Steam power plants which also remove additional bleeder steam at elevated pressure at the high-pressure turbine 4 for an additional feedwater preheating stage are also known. The high-pressure turbine 4, the intermediate-pressure turbine 7 and the low-pressure turbine 8 are in this case generally arranged on a common shaft 9, which is mounted rotatably by means of shaft bearings 12. The shaft 9 drives a rotor of a three-phase current generator 10 which is responsible for generating the current.

The service life of conventional steam power plants of this type is approximately 40 to 50 years. However, on account of their original design and the aging of components, relatively old steam power plants only achieve a moderate efficiency and therefore have an increased fuel demand, which is associated with high operating costs and emissions. Therefore, many relatively old steam power plants, even though in mechanical terms they are still functional and have by no means reached the end of their operating life, are uneconomical at producing electricity. This is true in particular in view of increased competition from markets where modern plants, including combined-cycle power plants, which have a gas turbine cycle and a steam turbine cycle, as described, for example, in DE 19542917 A1 or DE 19923210 A1, are operated.

One approach which is currently used to avoid losses of this nature is conventional retrofitting of relatively old steam power plants, in which only the steam path of the turbines is modified. For this purpose, new rotating and stationary turbine blades and vanes with an improved profile are exchanged for the old turbine blades and vanes. In general, only certain rows of blades or vanes are exchanged, while the other rows of these blades or vanes continue to operate unchanged. The result of this measure is that the power output by the steam power plant rises for the same fuel consumption with substantially unchanged steam conditions. Moreover, instead of exchanging only the turbine blades or vanes, it is also possible at the same time to exchange the entire rotor including the rotating blades and/or the stator in which the stationary vanes are arranged, and in this way to make better use of the existing steam turbine installation. A modification of this type alone does not require any major changes to the generator, the steam boiler, pipelines, condensers or buildings. The steam temperature and the steam pressure remain substantially unchanged in the event of a retrofit of this nature.

A drawback of this retrofitting measure is that the increase in output and efficiency is generally only moderate. Improving the efficiency, i.e. reducing the fuel consumption with an unchanged electrical output or increasing the electrical output with an unchanged fuel consumption, is too low, however, to greatly reduce the costs per kilowatt hour and to constitute a significantly more attractive solution in terms of achieving more competitive prices or reducing specific emissions. Consequently, the competitiveness of relatively old steam power plants can scarcely be increased to a significant degree in this way.

It is true that DE 19962386 A1 and DE 19962403 A1 disclose methods for retrofitting or converting a system which generates saturated steam with at least one steam turbine assembly, and power plants which have been retrofitted or converted using these methods. However, in this case it is proposed for a gas turbine set to be added as an addition to the steam turbine set, which is equivalent to restricting the fuel supply. Furthermore, this creates a combined-cycle installation, which is more complex to maintain than a pure steam turbine installation.

SUMMARY OF THE INVENTION

Accordingly, one object of the invention is to avoid the above-described drawbacks of the prior art. Furthermore, it is an object of the present invention to provide a possible way of improving the efficiency and/or extending the service life of existing steam power plants. The intention is to create solutions which are as inexpensive as possible and in which as many original parts of the existing steam power plant as possible continue to be used. Furthermore, as far as possible the general infrastructure is to be retained. Finally, the utilization of existing operating licenses often also plays an important role.

A steam power plant according to the invention with retrofit kit has a steam generator with superheater, a steam turbine set including condensation installations, connecting pipelines, auxiliary devices and a generator. According to the invention, the retrofit kit has at least one retrofit turbine module which is designed for elevated live steam temperatures of >565° C., preferably 620° C. to 720° C., and for unchanged or modified live steam pressure and which is connected upstream of the existing steam turbine set or is exchanged for the high-pressure turbine of the latter. In this context, the term turbine module is to be understood as encompassing not only the actual turbines but also the pipelines and valves which are required for the corresponding temperatures and pressures. Ultimately, the retrofit turbine module is supplied with steam which has suitable parameters.

According to the invention, it may prove worthwhile for the upstream high pressure also to perform the expansion of the existing high-pressure turbine, so that the existing high-pressure turbine can be replaced by the high-pressure turbine of the retrofit kit. The space which is released by the elimination of the high-pressure turbine of the existing steam power plant can advantageously be used for the turbine module of the retrofit kit. Furthermore, if the pressure remains constant or is reduced, many existing components of the steam power plant, such as for example the feedwater pump and pipelines, can advantageously continue to be used. Furthermore, this also creates the option of incorporating one or more additional preheating stages and thereby additionally increasing the efficiency.

Alternatively, the live steam pressure may be modified in such a way as to be ≧200 bar, preferably 240 bar to 375 bar. If exploitation of previous safety margins in the existing components is not sufficient to significantly increase the pressure, it will be necessary to correspondingly modify the components which are under pressure.

This avoids the drawbacks of the prior art and considerably improves the efficiency of the existing steam power plant. This manifests itself, for example, in the fact that a higher power output can be achieved with the same quantity of fuel or a smaller quantity of fuel is required for the same power output. On account of the fact that as many original parts of the steam power plant as possible are retained, the invention provides an inexpensive solution to increasing power. Moreover, the general infrastructure can be retained wherever it is economical and environmentally compatible to do so.

Another solution variant provides for only the live steam temperature to be increased, for example to 720° C., while the live steam pressure is reduced, for example to 100 bar. This may prove advantageous in particular in relatively old steam power plants, in which the most important factor is to extend the plant service life. In this case, it is possible to dispense with a reheater.

An increased live steam temperature can be realized, for example, by modifying the superheater or by means of external heat sources. Examples of suitable modifications to the superheater in this context include the use of materials which are able to withstand high temperatures, and also spatial and/or geometric changes to the superheater.

One advantageous embodiment of the steam power plant with retrofit kit according to the invention provides for the shaft of the retrofit turbine module and the shaft of the existing steam turbine set to be mechanically coupled to one another. For this purpose, the existing generator may have to be adapted or replaced, or the power output may have to be limited to an acceptable level. Alternatively, by way of example, it is also possible for an additional generator to be added at an end of the shaft which is still free in order to take off the excess power.

An alternative advantageous embodiment of the steam power plant with retrofit kit according to the invention provides for the shaft of the retrofit turbine module and the shaft of the existing steam turbine set to be mechanically decoupled. This is advantageous if the local conditions do not allow the retrofit turbine module to be connected upstream as an extension to the shaft of the existing turbine set. In this case, the power of the retrofit turbine module can be tapped off via a separate generator, which is arranged at a free end of the shaft of the retrofit turbine module. This also allows the rotational speed of this retrofit to be selected optimally.

According to an advantageous refinement of the steam power plant with retrofit kit according to the invention, the turbine module of the retrofit kit is made from materials which are able to withstand high temperatures, preferably from nickel-base alloys. Alloys of this type are particularly suitable for high steam temperatures. Depending on the particular component, alloys such as IN617, IN625 or Waspaloy are suitable.

Moreover, according to an advantageous refinement of the steam power plant with retrofit kit according to the invention, the retrofit turbine module has a single-flow or multiflow high-pressure turbine. In this case, the live steam temperature which is present at the turbine inlet may be approximately 720° C., and the live steam pressure may be 375 bar. The working steam emerging from the (super) high-pressure turbine of the retrofit turbine module connected upstream is generally intended for use as the input steam for the high-pressure turbine of the existing turbine assembly.

According to an advantageous refinement of the steam power plant with retrofit kit according to the invention, the retrofit turbine module has a single-flow or multiflow super high-pressure turbine and a single-flow or multiflow super intermediate-pressure turbine. With this variant of a retrofit turbine module according to the invention, the live steam temperature which is present at the inlet to the high-pressure turbine may, for example, be 620° C. and the live steam pressure may be approximately 240 bar. The working steam which emerges from the super high-pressure turbine of the retrofit turbine module connected upstream is generally used as input steam for the high-pressure turbine of the existing turbine assembly. In this case, the inlet temperature at this high-pressure turbine may remain unchanged, for example at 540° C., and the entry pressure may be 150 bar. In this embodiment, the working steam is already at a higher pressure when it is removed from the high-pressure turbine which is to be modified and is heated again via a further reheater, for example to approximately 60 bar/620° C, in order to be fed to a turbine which is connected upstream of the existing intermediate-pressure turbine and which expands the steam to the previous entry state of the existing intermediate-pressure turbine. If it is not worth modifying the existing high-pressure turbine, the upstream super high pressure can additionally also be designed for the residual expansion of the existing high-pressure turbine, so that this existing component can be removed. Irrespective of whether a modified high-pressure part remains between super high pressure and super intermediate pressure, the super high-pressure turbine and super intermediate-pressure turbine of the retrofit turbine module can be accommodated in a common housing or in separate housings. If they are arranged in a common housing, it is possible to save material, which contributes to reducing the production costs. Furthermore, an arrangement of this nature saves further space, with the result that even sites where there is little space available can be retrofitted accordingly.

In the steam power plant with retrofit kit according to the invention, it is advantageous if the retrofit kit has a modified steam generator and/or superheater for generating live steam at an elevated steam temperature of >565° C., preferably 620°

C. to 720° C., and an unchanged or modified steam pressure. In this case, the existing steam generator and/or superheater may, if technically feasible, be modified, for example, for higher steam temperatures and if appropriate a higher steam pressure or may be exchanged for a retrofit steam generator and/or superheater which is suitable for the production of temperatures of >565° C. and if appropriate pressures of ≧200 bar. Alternatively, it is also possible for a further steam generator and/or superheater, which can also be operated with an external heat source, to be connected downstream. Retrofit steam generators of this type may be made partially, for example, from nickel-base alloys.

According to an advantageous refinement of the steam power plant according to the invention, there is an additional generator or a modified or exchanged generator for taking off the increased power which is generated by the retrofit turbine set. In this case, an additional generator can be added next to the existing generator, on the same shaft or a separate shaft, or the existing generator can be upgraded by modification, for example to the winding, or alternatively the existing generator can be completely replaced by a new generator.

A method according to the invention for retrofitting an existing steam power plant having a steam generator with superheater, a steam turbine set including condensation installations, connecting pipelines, auxiliary devices and a generator, includes the following steps:

connecting a retrofit turbine module for live steam with an elevated steam temperature and an unchanged or modified live steam pressure upstream of the existing turbine set or exchanging the high-pressure turbine of the existing steam turbine set for the retrofit turbine module;

providing a steam generator and/or superheater for providing live steam with an elevated steam temperature.

If necessary, the steam generator and/or the superheater and the feedwater pump can be retrofitted or converted, or an additional feedwater pump, referred to as a booster pump, can be added, and the associated pipelines can be modified for the higher live steam pressure.

This avoids the drawbacks of the prior art and significantly improves the efficiency and/or the service life of the existing steam power plant. The fact that as many original parts of the steam power plant as possible are retained means that the invention provides an inexpensive solution to increasing power. Moreover, the general infrastructure can be retained wherever it is economical and environmentally compatible to do so. In this case, the specific spatial arrangement can be adapted to local conditions. It is advantageous if the pipelines between steam generator and retrofit turbine module are kept as short as possible, in order to restrict the use of materials which are able to withstand high temperatures to the minimum necessary.

An advantageous refinement of the method according to the invention for retrofitting a steam power plant also includes the following step:

adding, exchanging or modifying a generator for taking off the additional power produced by the retrofit turbine set. In this case, the addition of an additional generator can be effected, for example, by fitting it to a free end of the shaft, or if appropriate the additional generator can be coupled only to the separately disposed retrofit turbine set.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
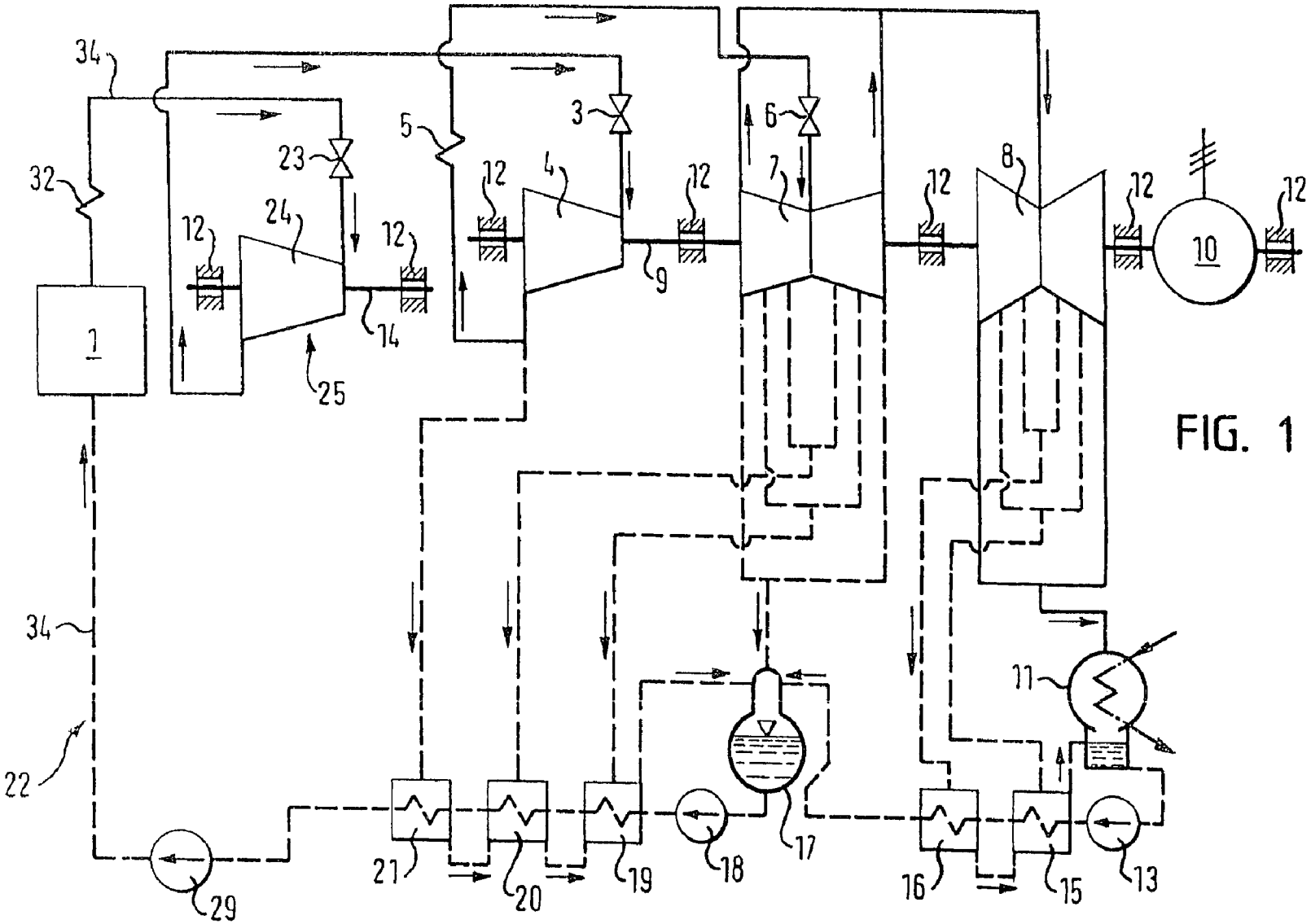
FIG. 1 shows a schematic circuit diagram of a first embodiment of a steam power plant with retrofit kit.

Referring now to the drawings, which illustrates only those components which are pertinent to gaining an understanding of the invention and wherein like reference numerals designate identical or corresponding parts throughout the several views, FIG. 1 shows a schematic circuit diagram of a first advantageous embodiment of a steam power plant 22 with retrofit kit according to the invention. Condensate or boiler feedwater is brought to the desired steam temperature in a steam generator 1 which has been modified with materials which are suitable for high operating temperatures and high operating pressures, is designed as a steam boiler and has a superheater 32. A feedwater pump which is additionally to be installed and is referred to as booster pump 29 (and/or the adaptation or replacement of components 18 to 21) ensures that the required pressure is provided. Alternatively, the components 18 to 21 which are known from the prior art can also be adapted or replaced. To enable the feedwater and the steam to be safety conveyed under the elevated pressure, modified pressure lines 34 are additionally provided between the booster pump 29 and the live steam valves 23. In the present exemplary embodiment, the live steam temperature is approximately 700° C., and the live steam pressure is approximately 375 bar.

The steam passes via a modified live steam superheater 32 and corresponding live steam valves 23 into a super high-pressure turbine 24 of a retrofit turbine module 25. In the present exemplary embodiment shown in FIG. 1, the super high-pressure turbine 24 is of single-flow design. The steam path of the retrofitted super high-pressure turbine 24 is made from materials which are able to withstand high temperatures, namely from nickel-base alloys. The inlet temperature of the live steam is approximately 700° C., and the inlet steam pressure is approximately 375 bar. Optimization of the plant economics may also justify the avoidance of high-temperature materials, by selection of a process which is operated at only, for example, 620° C and 240 bar. The super high-pressure turbine 24 is in this case mounted on a dedicated shaft 14 which is separate from the shaft 9 of the existing turbine assembly. The power which is generated here is tapped off by an additional generator (not shown) and converted into current.

Via a line, the steam which emerges from the super high-pressure turbine 24 passes directly or via the decommissioned, existing live steam valves 3 into the single-flow high-pressure turbine 4 of the existing steam power plant. In this example, the unchanged turbine inlet temperature is 540° C. and the turbine inlet pressure is 150 bar.

At the outlet from the high-pressure turbine 4, the steam is divided into a stream which is fed to a high-pressure feedwater preheater 21 and a stream which is fed to a reheater 5. The steam which is fed to the high-pressure feedwater preheater 21 is also known as bleeder steam for the feedwater preheating and is used to heat the feedwater by means of heat exchangers.

The second part-stream passes via the reheater 5 and the collecting valves 6 into the intermediate-pressure turbine 7, which in this example is of two-flow design, the pressure and temperature in this case typically remaining unchanged at 36 bar and, for example, 540° C. Bleeder steam for the feedwater preheating likewise passes from the intermediate-pressure turbine 7 into the high-pressure feedwater preheaters 19 and 20 and/or directly into the feedwater tank 17. The other part of the flow of steam, which is also referred to as the working steam, passes into the two-flow low-pressure turbine 8, from where the working steam which emerges flows into a condenser 11, in which the steam is condensed by means of a heat exchanger through which cooling water flows.

The condensate is preheated by means of low-pressure feedwater preheaters 15, 16 and is fed to the feedwater tank 17. The preheating in the low-pressure feedwater preheaters 15, 16 is carried out using bleeder steam from the low-pressure turbine 8.

The high-pressure turbine 4, the intermediate-pressure turbine 7 and the low-pressure turbine 8 in this case form the turbine assembly of the existing steam power plant. Depending on requirements, the blades and vanes of this turbine assembly may be replaced by new blades and vanes with a modified profile. The turbine assembly is in this case mounted on the common shaft 9, which is mounted rotatably by means of shaft bearings 12. The shaft 9 drives a rotor of a three-phase current generator 10 which is responsible for the generation of current.

Figure 2:
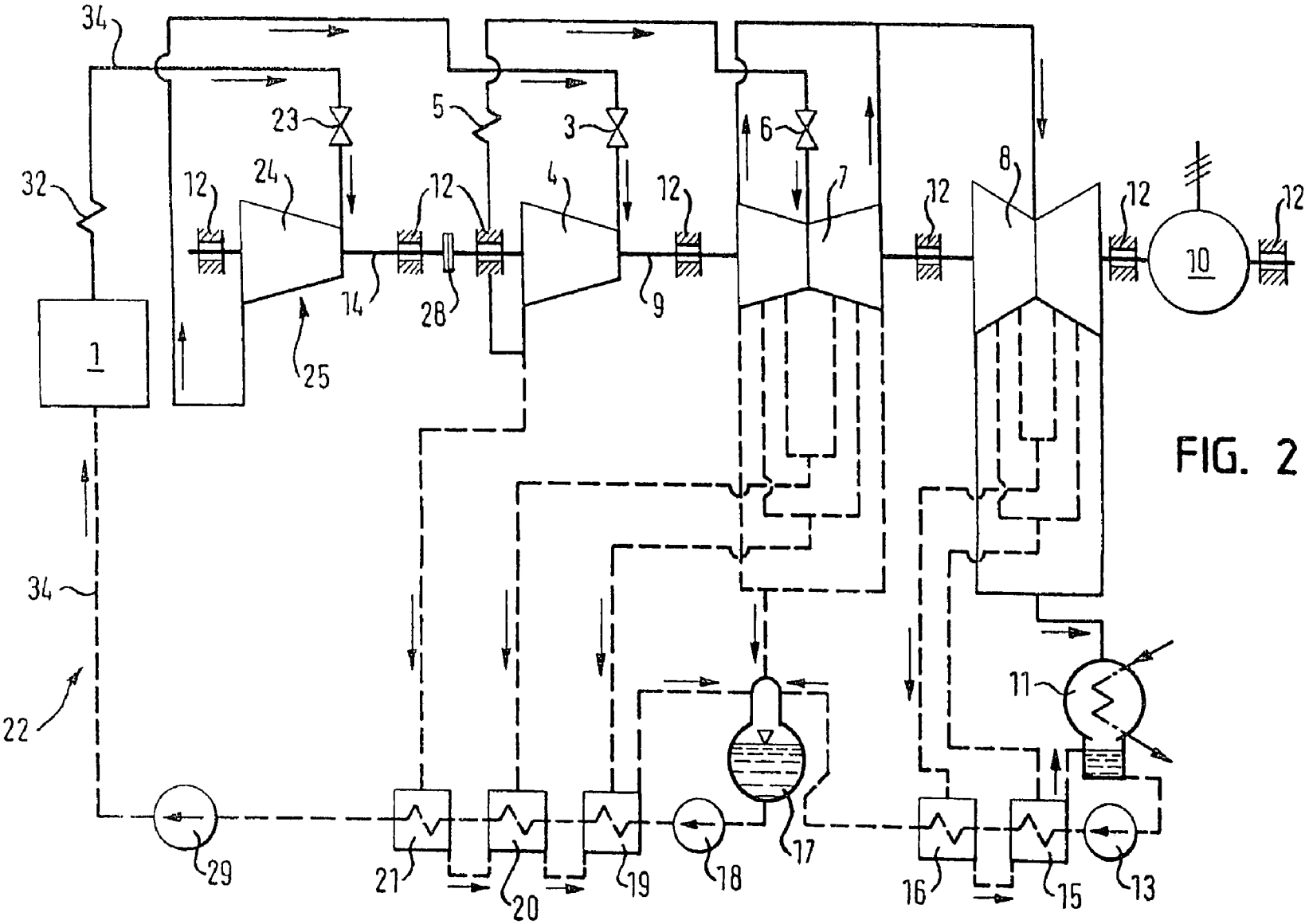
FIG. 2 shows a schematic circuit diagram of a second embodiment of a steam power plant with retrofit kit.

FIG. 2 shows a diagrammatic circuit diagram of a second advantageous embodiment of a steam power plant 22 with retrofit kit according to the invention. According to this exemplary embodiment, condensate or boiler feedwater is likewise brought to the desired steam temperature of, for example, 700° C. in a modified steam boiler 1 with superheater 32 and is brought to the desired steam pressure of, for example, 375 bar by a booster pump 29. Alternatively, it is also possible to suitably adapt the feedwater pump.

The working steam passes via a modified live steam superheater 32 and corresponding live steam valves 23 into the super high-pressure turbine 24 of the retrofit turbine module 25. In the present exemplary embodiment, the super high-pressure turbine 24 is of single-flow design and has a steam path made from nickel-base alloys which are able to withstand high temperatures. The inlet temperature of the live steam is approximately 700° C. and the inlet steam pressure is approximately 375 bar. Optimization of the process economics may also justify the avoidance of high-temperature materials by selection of a process which only operates at, for example, 620° C. and 240 bar. According to the second exemplary embodiment, shown in FIG. 2, the super high-pressure turbine 24 is mounted on a shaft 14, which is connected to the shaft 9 of the existing turbine assembly of the retrofitted steam power plant via a coupling 28.

The steam passes directly or via the corresponding, decommissioned live steam valves 3 into the single-flow high-pressure turbine 4 of the existing steam power plant. Here, just as before the retrofit, the turbine inlet temperature is still, for example, 540° C. and the turbine inlet pressure 150 bar.

The steam is divided at the outlet from the high-pressure turbine 4 into bleeder steam which is fed to a high-pressure feedwater preheater 21 and working steam which is fed to a reheater 5.

The working steam passes via the reheater 5 and the collecting valves 6 into the intermediate-pressure turbine 7, which in this example is of two-flow design, with the pressure here too remaining unchanged, typically at 36 bar, and the temperature at, for example, 540° C. Bleeder steam for feedwater preheating likewise passes from the intermediate-pressure turbine 7 into the high-pressure feedwater preheaters 19 and 20 and/or directly into the feedwater tank 17. The working steam passes into the two-flow low-pressure-turbine 8, from where it flows into a condenser 11, in which the steam is condensed by means of a heat exchanger through which cooling water flows.

The condensate is preheated by means of low-pressure feedwater preheaters 15, 16 and is fed to the feedwater tank 17. The preheating in the low-pressure feedwater preheaters 15, 16 is carried out using bleeder steam from the low-pressure turbine 8.

The high-pressure turbine 4, the intermediate-pressure turbine 7 and the low-pressure turbine 8 form the turbine assembly of the existing steam power plant. Depending on the particular requirements, the blades and vanes of this turbine assembly may be replaced with new blades and vanes with a modified profile. The turbine assembly is arranged on the common shaft 9, which is mounted rotatably by means of shaft bearings 12.

In the second exemplary embodiment, shown in FIG. 2, the shaft 9, together with the super high-pressure turbine 24 connected to the shaft 9 via the coupling 28, drives the three-phase current generator 10. The generator 10 may in this case be modified in such a way that it is able to take up the increased power which is produced as a result of the upstream connection of the super high-pressure turbine 24, or alternatively the power which is output is limited to a permissible level.

Figure 3:
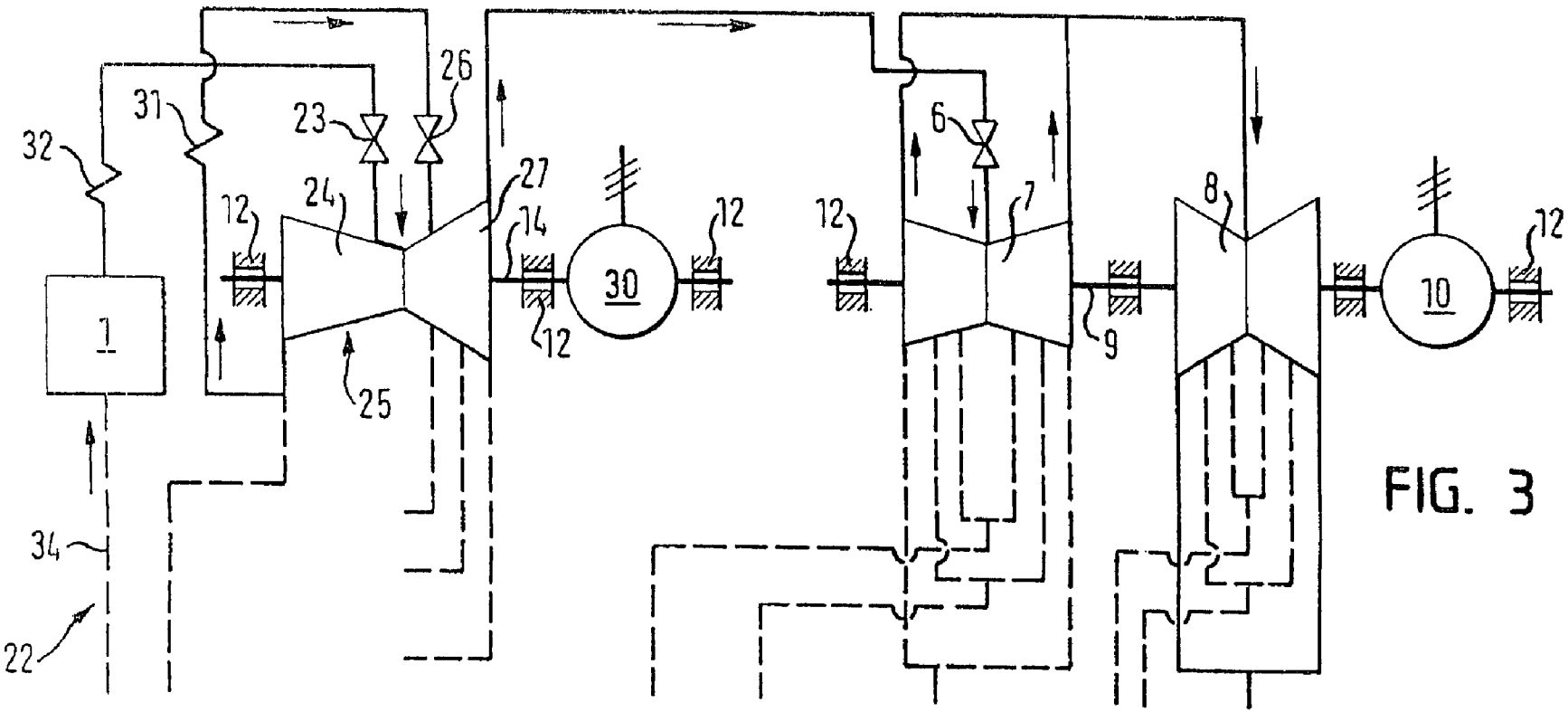
FIG. 3 shows a schematic circuit diagram of a third embodiment of a steam power plant with retrofit kit.

FIG. 3 shows a schematic circuit diagram of a third advantageous embodiment of a steam power plant 22 with retrofit kit according to the invention. According to this exemplary embodiment, condensate or boiler feedwater is brought to the desired steam temperature of, for example, 620° C. in a steam boiler 1 which has been modified for the increased temperatures and pressures and has a superheater 32, and is brought to the desired steam pressure of, for example, 240 bar by the booster pump 29. The line 34, which is operating at an increased pressure, is in this case correspondingly modified.

Via a live steam superheater 32 and corresponding live steam valves 23, the steam passes into a retrofit turbine module 25, which in the present exemplary embodiment shown in FIG. 3 has a super high-pressure turbine 24 and a super intermediate-pressure turbine 27. The super high-pressure turbine 24 and the super intermediate-pressure turbine 27 are in each case of single-flow design and are arranged in a common housing. The steam path of the retrofitted super high-pressure turbine 24 and the steam path of the retrofitted super intermediate-pressure turbine 27 are made from materials which are able to withstand high temperatures.

In the present, third exemplary embodiment, shown in FIG. 3, the inlet temperature of the live steam is, for example, 620° C. and the inlet steam pressure is, for example, 240 bar. The super high-pressure turbine 24 and the super intermediate-pressure turbine 27 are mounted on a common shaft 14, which is separate from the shaft 9 of the existing turbine assembly. The power produced here is tapped off by an additional generator 30 and converted into current.

Via a reheater 31 and collecting valves 26, the working steam then passes from the super high-pressure turbine 24 into the super intermediate-pressure turbine 27 of the retrofit turbine module 25. The turbine inlet temperature of the working steam is in this case likewise, for example, 620° C., and the turbine inlet pressure is approximately 60 bar.

At the outlet of the super intermediate-pressure turbine 27, the working steam is passed directly or via the existing, decommissioned collection valves 6 into the intermediate-pressure turbine 7, which in this example is of two-flow design, of the existing steam turbine module, the pressure here remaining unchanged at, for example, 36 bar, and the temperature is 540° C. The working steam passes from the intermediate-pressure turbine 7 into the low-pressure turbine 8, which in this exemplary embodiment is of two-flow design.

The bleeder steam for the feedwater preheating, which is used to heat the feedwater by means of heat exchangers, and the return of the condensate to the steam boiler are only diagrammatically indicated in FIG. 3.

In this exemplary embodiment, the original high-pressure turbine is replaced by the retrofit turbine module 25, which comprises a super high-pressure turbine 24 and a super intermediate-pressure turbine 27. The intermediate-pressure turbine 7 and the low-pressure turbine 8 in this case form the turbine assembly of the existing steam power plant. Depending on the particular requirements, the blades and vanes of this turbine assembly can be replaced by new blades and vanes with a modified profile. The existing turbine assembly is in this case arranged on a common shaft 9, which is rotatably mounted by means of shaft bearings 12. In the exemplary embodiment shown in FIG. 3, the shaft 9 drives the original three-phase current generator 10 of the existing steam power plant.

Figure 4:
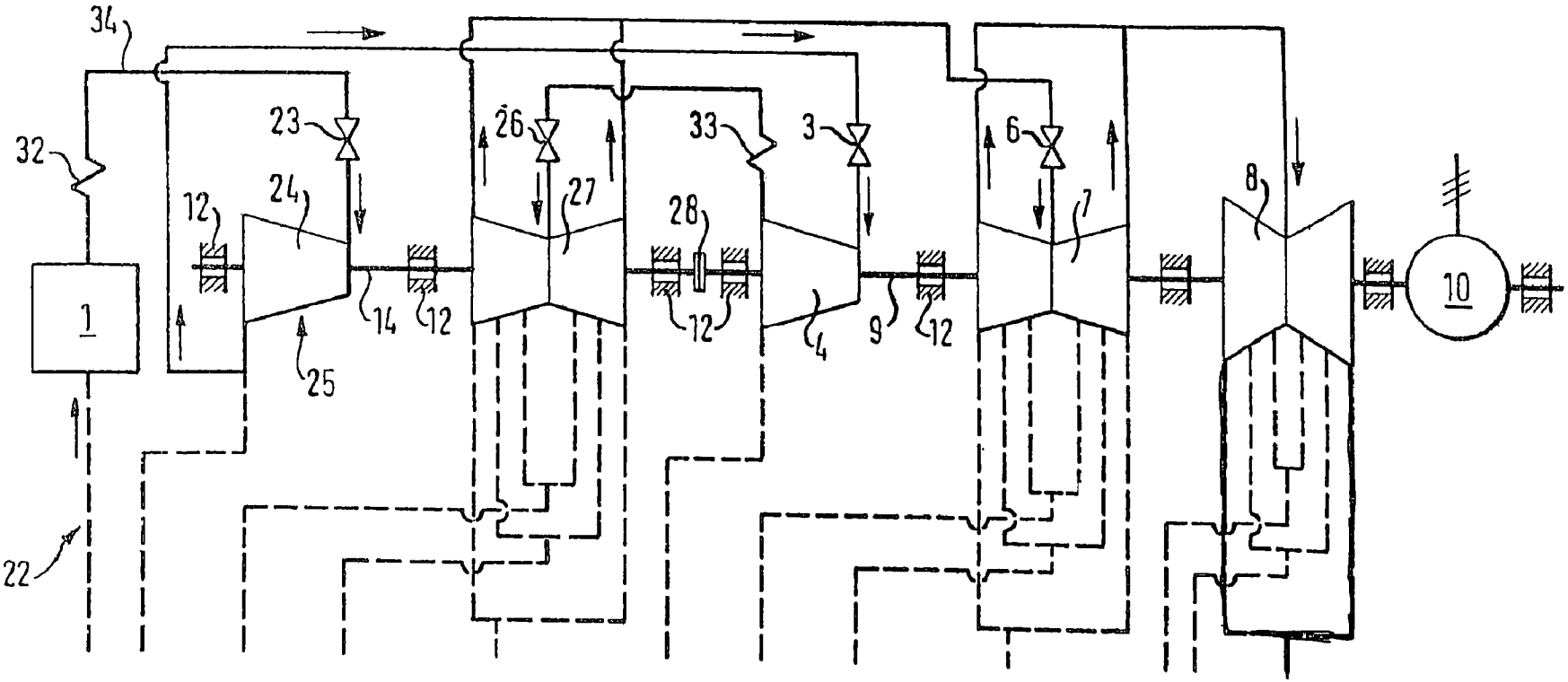
FIG. 4 shows a schematic circuit diagram of a fourth embodiment of a steam power plant with retrofit kit.

FIG. 4 shows a schematic circuit diagram of a fourth advantageous embodiment of a steam power plant 22 with retrofit kit according to the invention. According to this exemplary embodiment, condensate or boiler feedwater is likewise brought to the desired steam temperature of, for example, 620° C. in a steam boiler 1 and superheater 32 which have been modified for the elevated temperatures and pressures and is also brought to the desired steam pressure of, for example, 240 bar by the booster pump 29 or by suitable adapting of the feedwater pump. The line 34, which is operating at elevated temperature, has in this case been modified accordingly.

Via the modified live steam superheater 32 and corresponding live steam valves 23, the steam passes into a retrofit turbine module 25, which in the present exemplary embodiment has a super high-pressure turbine 24 and a super intermediate-pressure turbine 27. The super high-pressure turbine 24 is in this case of single-flow design, while the super intermediate-pressure turbine 27 is of two-flow design. The steam path of the retrofitted super high-pressure turbine 24 and the steam path of the retrofitted intermediate-pressure turbine 27 are made from materials which are able to withstand high temperatures. In the present exemplary embodiment, the inlet temperature of the live steam is, for example, 620° C., and the inlet steam pressure is, for example, 240 bar. The super high-pressure turbine 24 and the super intermediate-pressure turbine 27 are mounted on a common shaft 14, which is connected to the shaft 9 of the existing turbine assembly via a coupling 28.

The working steam passes directly or via the existing, decommissioned live steam valves 3 into the single-flow high-pressure turbine 4 of the existing steam power plant. The turbine inlet temperature of the working steam here remains unchanged at 540° C., and the turbine inlet pressure is, for example 150 bar. The existing high-pressure turbine has to be converted such that the steam can be removed at the pressure required for the increased reheater pressure. Via a reheater 33 and collection valves 26, the working steam passes into the super intermediate-pressure turbine 27 of the retrofit turbine module 25. Here, the turbine inlet temperature after the reheating is, for example, once again 620° C. and the turbine inlet pressure is, for example, 60 bar. At the outlet from the super intermediate-pressure turbine 27, the working steam is passed directly or via the decommissioned collection valves 6 into the intermediate-pressure turbine 7, which is of two-flow design, with the pressure here remaining unchanged at 36 bar and the temperature being 540° C. The working steam passes from the intermediate-pressure turbine 7 into the two-flow low-pressure turbine 8.

The bleeder steam for the feedwater preheating, which is used to heat the feedwater by means of heat exchangers, and the return of the condensate into the steam boiler are only diagrammatically indicated in FIG. 4.

The high-pressure turbine 4, which is to be modified on account of the high outlet pressure, the intermediate-pressure turbine 7 and the low-pressure turbine 8 in this case form the turbine assembly of the existing steam power plant. Depending on the particular requirements, the blades and vanes of this turbine assembly can be replaced with new blades and vanes with a modified profile. The turbine assembly is in this case arranged on the common shaft 9, which is mounted rotatably by means of shaft bearings 12. In the exemplary embodiment shown in FIG. 4, the shaft 9, together with the retrofit turbine set 25 connected to the shaft 9 via the coupling 28, drives the three-phase current generator 10. The generator 10 is in this case if necessary modified in such a way that it can take up the increased power which is produced as a result of the retrofit turbine set being connected upstream, or alternatively the power which is output is limited to an acceptable level.

Figure 5:
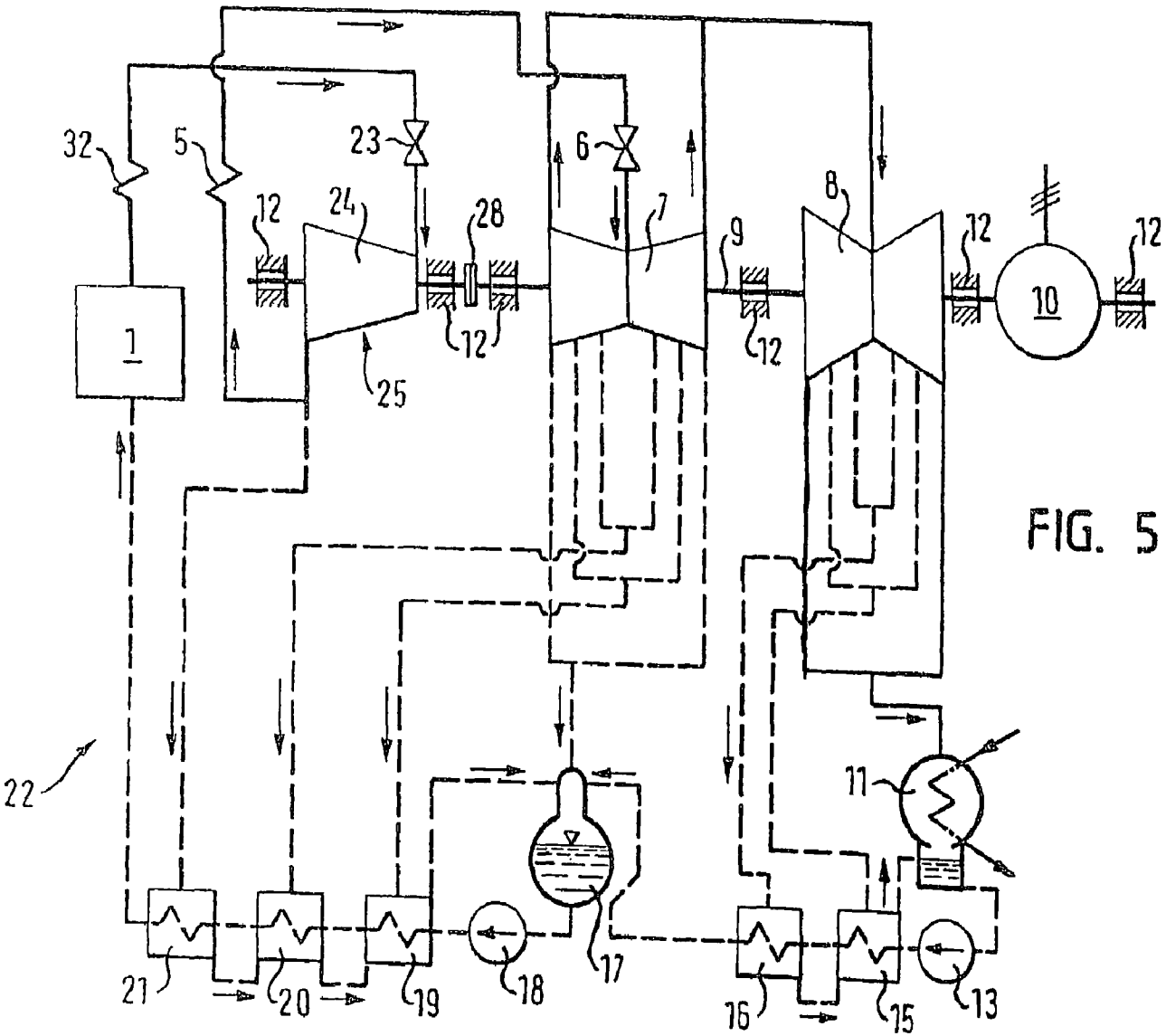
FIG. 5 shows a schematic circuit diagram of a fifth embodiment of a steam power plant with retrofit kit.

FIG. 5 shows a schematic circuit diagram of a fifth advantageous exemplary embodiment of a steam power plant 22 with retrofit kit according to the invention. In a superheater 32 which has been modified for high operating temperatures, the steam is brought to the desired steam temperature after it has passed through the steam generator 1. In the present exemplary embodiment, the live steam temperature is approximately 700° C., the live steam pressure remains unchanged at, for example, 150 bar.

After it has passed through the live steam superheater 32 and corresponding live steam valves 23, the steam passes into a super high-pressure turbine 24 of a retrofit turbine module 25. The super high-pressure turbine 24 in this case completely replaces the high-pressure turbine of the existing power plant and is connected to the shaft 9 of the existing steam turbine assembly via a coupling 28.

At the outlet from the super high-pressure turbine 24, the steam passes via a reheater 5 and the collecting valves 6 into the intermediate-pressure turbine 7, the pressure and temperature here typically being 36 bar and, for example, 540° C. Steam passes from the intermediate-pressure turbine 7 into the two-flow low-pressure turbine 8, from where the working steam which emerges flows into a condenser 11, in which the steam is condensed by means of a heat exchanger through which cooling water flows.

In this exemplary embodiment too, the increased power can be tapped off by means of a modified generator 10.

Figure 6:
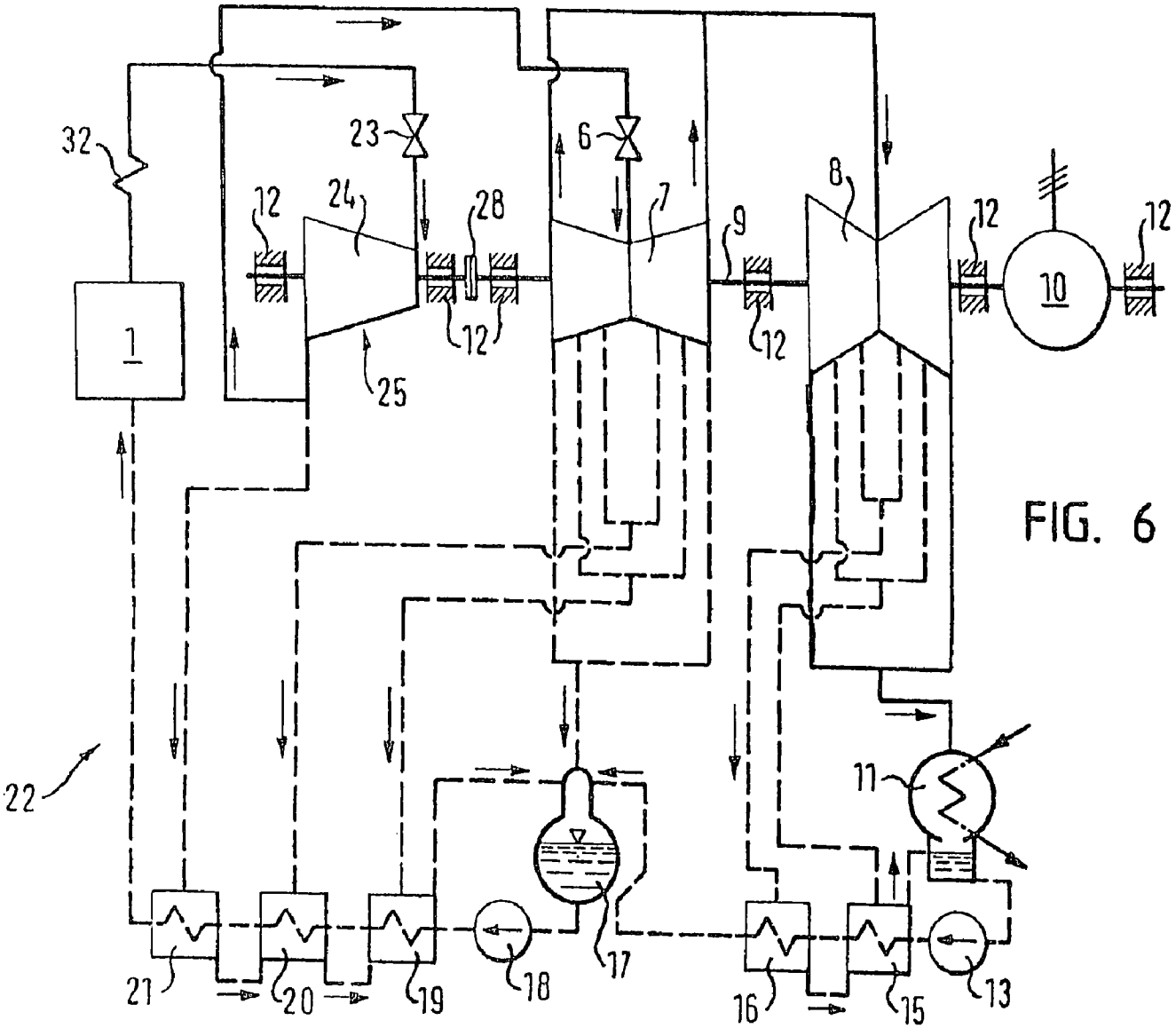
FIG. 6 shows a schematic circuit diagram of a sixth embodiment of a steam power plant with retrofit kit.
Figure 7:
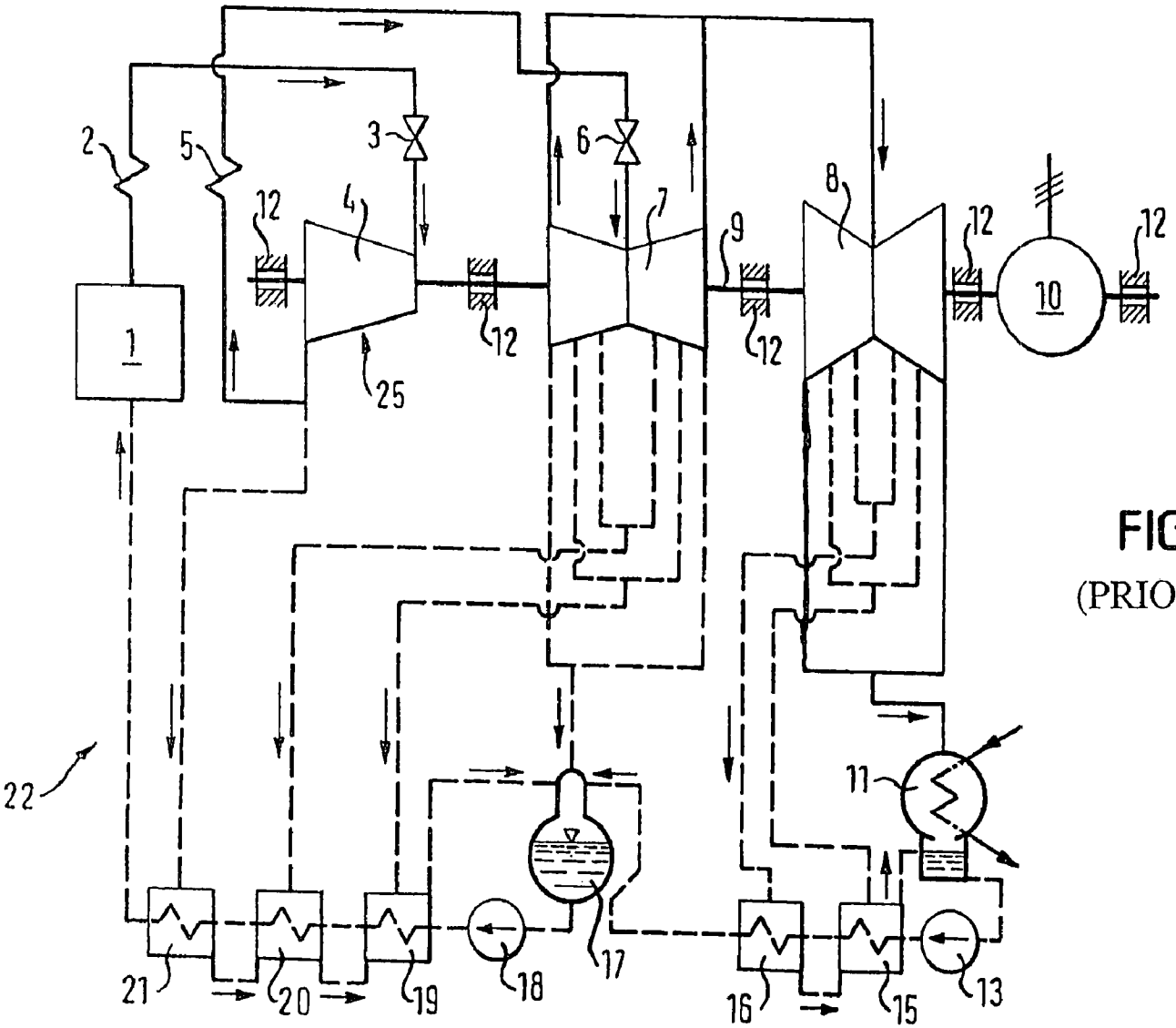
FIG. 7 (PRIOR ART)
FIG. 7 shows a schematic circuit diagram of a conventional steam power plant from the prior art.

Finally, FIG. 6 shows a schematic circuit diagram of a sixth advantageous embodiment of a steam power plant 22 with retrofit kit according to the invention. This variant is intended for high operating temperatures of around 720° C. and low operating pressures of around 100 bar, meaning that the original components of the existing steam power plant can be substantially retained and there is no need for major conversion of the steam boiler 1. It is also possible for the existing boiler feed pump 18 to operate at reduced pressure.

Substantially all that is required is a modified superheater 32 and the super high-pressure turbine 24. The super high-pressure turbine 24 in this case completely replaces the high-pressure turbine of the existing power plant and is connected to the shaft 9 of the existing steam turbine assembly via a coupling 28.

The steam passes into the super high-pressure turbine 24 of the retrofit turbine module 25 via the modified live steam superheater 32 and corresponding live steam valves 23.

At the outlet from the super high-pressure turbine 24, the steam passes directly or via the decommissioned collecting valves 6 into the intermediate-pressure turbine 7, the pressure and temperature here typically being 36 bar and, for example, 540° C. There is no need for a reheater here. From the intermediate-pressure turbine 7, steam passes into the low-pressure turbine 8. The power is output to the original generator 10 connected to the shaft 9.

This sixth embodiment is suitable in particular for continuing operation of steam power plants beyond their normal service life for little investment. Since the material fatigue on the high-pressure side in this case now only allows pressures which are below the original design pressures, the steam pressures acting on the components are lower than in the original design of the existing steam power plant. Since in this special application a significant increase in power is not generally expected, the original generator 10 can often be retained unchanged.

The advantageous exemplary embodiments described above avoid the drawbacks of the prior art and improve the efficiency and/or the service life of the existing steam power plant. On account of the fact that as many original parts of the steam power plant as possible are retained, the invention provides an inexpensive solution to achieve this. Moreover, the general infrastructure can be retained wherever it is economical and environmentally compatible to do so.

The present invention is not restricted by the exemplary embodiments described, but rather is defined only by the scope of protection of the appended claims as they will be understood by a person skilled in the art. In particular, the part-components shown in the exemplary embodiments can in many cases be combined with one another. Obviously, numerous modifications and variations of the present invention are possible in light of the above teachings. It is therefore to be understood that within the scope of the appended claims, the invention may be practiced otherwise than is specifically described herein.

LIST OF DESIGNATIONS

1 Steam generator, steam boiler
2 Superheater
3 Live steam valve
4 High-pressure turbine
5 Reheater
6 Collecting valve
7 Intermediate-pressure turbine
8 Low-pressure turbine
9 Shaft
10 Three-phase current generator
11 Condensation installation, condenser
12 Shaft bearing
13 Condensate pump
14 Shaft
15 Low-pressure feedwater preheater
16 Low-pressure feedwater preheater
17 Feedwater tank
18 Boiler feed pump
19 High-pressure feedwater preheater
20 High-pressure feedwater preheater
21 High-pressure feedwater preheater
22 Steam power plant with retrofit kit
23 Live steam valve
24 Super high-pressure turbine
25 Retrofit turbine module
26 Collecting valve
27 Super intermediate-pressure turbine
28 Coupling
29 Booster pump
30 Three-phase current generator
31 Reheater
32 Superheater
33 Reheater
34 Modified pressure line

The invention claimed is:

1. A steam power plant with retrofit kit comprising:

a steam power plant having a steam generator with a superheater, a steam turbine set including a high-pressure turbine, condensation installations, connecting pipelines, auxiliary devices, and a generator;

a retrofit kit including at least one retrofit turbine module configured and arranged for elevated live steam temperatures of >565° C. and for modified live steam pressure between 250 bar and 375 bar, the at least one retrofit turbine module being connected upstream of the steam turbine set or exchanged for the high-pressure turbine of the steam turbine set;

a common housing; and wherein the at least one retrofit turbine module comprises a single-flow or multi-flow super high-pressure turbine and a single-flow or multi-flow super intermediate-pressure turbine arranged in the common housing.

2. A steam power plant with retrofit kit comprising:

a steam power plant having a steam generator with superheater, a steam turbine set including a high-pressure turbine, condensation installations, connecting pipelines, auxiliary devices, and a generator;

a retrofit kit including at least one retrofit turbine module configured and arranged for elevated live steam temperatures of >565° C. and for a modified live steam pressure, the at least one retrofit turbine module being connected upstream of the steam turbine set or exchanged for the high-pressure turbine of the steam turbine set;

wherein the modified live steam pressure is lower than the live steam pressure of the steam turbine set;

wherein the combination of said elevated live steam temperatures and said lower live steam pressure are together selected such that modification of the steam generator due to pressure and temperature is unnecessary;

a common housing; and wherein the at least one retrofit turbine module comprises a single-flow or multi-flow super high-pressure turbine and a single-flow or multi-flow super intermediate-pressure turbine arranged in the common housing.

3. The steam power plant as claimed in claim 1, wherein the at least one retrofit turbine module includes a shaft, and the steam turbine set includes a shaft that is mechanically coupled to the shaft of the at least one retrofit turbine module.

4. The steam power plant as claimed in claim 1, wherein the at least one retrofit turbine module includes a shaft, and the steam turbine set includes a shaft that is mechanically decoupled from the shaft of the at least one retrofit turbine module.

5. The steam power plant as claimed in claim 1, wherein the at least one retrofit turbine module is made from materials which are able to withstand high temperatures.

6. The steam power plant as claimed in claim 1, wherein the at least one retrofit turbine module comprises a single-flow or multiflow super high-pressure turbine.

7. The steam power plant as claimed in claim 1, wherein the at least one retrofit turbine module comprises a single-flow or multiflow super high-pressure turbine and a single-flow or multiflow super intermediate-pressure turbine.

8. The steam power plant as claimed in claim 1, wherein the retrofit kit comprises a modified steam generator, a superheater, or both, for generating live steam at an elevated steam temperature of >565° C., and an unchanged or modified steam pressure.

9. The steam power plant as claimed in claim 1, further comprising:

an additional generator or a modified or exchanged generator configured an arranged for taking off the increased power which is generated by the retrofit turbine set.

10. The steam power plant as claimed in claim 1, wherein the at least one retrofit turbine module is configured and arranged for elevated live steam temperatures of between 620° C. and 720° C.

11. The steam power plant as claimed in claim 2, wherein the modified live steam pressure is about 100 bar.

12. The steam power plant as claimed in claim 5, wherein the at least one retrofit turbine module is made from steel or a nickel-based alloy.

13. The steam power plant as claimed in claim 8, wherein the elevated steam temperature is between 620° C. and 720° C.

* * * * *